US005429543A

United States Patent [19]

Tilbor et al.

[11] Patent Number: 5,429,543

[45] Date of Patent: Jul. 4, 1995

[54] VEHICLE TOY

[75] Inventors: Neil Tilbor, Medford; Jonathan A. Jaffe, Voorhees, both of N.J.; Shohei Suto, Tokyo, Japan

[73] Assignee: Tyco Investment Corp., Wilmington, Del.

[21] Appl. No.: 923,277

[22] Filed: Jul. 31, 1992

[51] Int. Cl.[6] ..... A63H 30/04; A63H 29/22; B62D 61/10; B60K 1/02

[52] U.S. Cl. ..... 446/456; 446/443; 446/470; 446/460; 180/22; 180/65.6; 180/6.5; 180/24.07

[58] Field of Search ..... 446/443, 433, 454–456, 446/458, 460, 466, 470, 465; 180/22, 65.6, 6.5, 24.07

[56] References Cited

U.S. PATENT DOCUMENTS

| | | | |
|---|---|---|---|
| D. 247,192 | 2/1978 | Gardner | D34/15 |
| 2,224,411 | 12/1940 | Smith | 180/65.6 X |
| 2,601,006 | 6/1952 | Rodabaugh | 446/460 X |
| 3,190,384 | 6/1965 | Dufresne | 180/6.7 |
| 3,351,037 | 11/1967 | Meili . | |
| 3,372,766 | 3/1968 | Lifferth | 180/22 X |
| 3,720,019 | 3/1973 | Waznys et al. | 46/244 A |
| 4,156,986 | 6/1979 | Kupperman et al. | 46/201 |
| 4,213,270 | 7/1980 | Oda | 446/456 |
| 4,226,292 | 10/1980 | Monte et al. | 180/6.5 |
| 4,306,630 | 12/1981 | Monte et al. | 180/167 |
| 4,459,776 | 7/1984 | Jaworski et al. | 446/462 |
| 4,475,611 | 10/1984 | Fisher | 180/6.5 |
| 4,508,516 | 4/1985 | D'Andrade et al. | 446/443 |
| 4,511,343 | 4/1985 | Goldfarb et al. | 446/463 |
| 4,562,893 | 1/1986 | Cunard | 180/6.5 |
| 4,576,583 | 3/1986 | Yoneda | 446/94 |
| 4,654,659 | 3/1987 | Kubo | 340/825.76 |
| 4,717,367 | 1/1988 | Stubenfoll et al. | 446/437 |
| 4,729,444 | 3/1988 | Tubman | 180/6.5 X |
| 4,813,906 | 3/1989 | Matsuyama et al. | 446/457 |
| 4,892,503 | 1/1990 | Kumazawa | 446/456 |
| 5,135,427 | 8/1992 | Suto et al. | 446/433 |

FOREIGN PATENT DOCUMENTS

| | | | |
|---|---|---|---|
| 9111296 | 1/1992 | Germany . | |
| 132479 | 5/1989 | Japan | 180/22 |
| 142960 | 5/1920 | United Kingdom | 446/433 |

OTHER PUBLICATIONS

Taiyo Kogyo Co., Ltd. 1985 Radio Control Catalog (pp. 6–8, 31).

1986 Tyco Catalog (cover page and p. 65).

1983 Ideal Catalog (cover page, pp. 16, 17, 30–33).

Taiyo 6WD Drawing.

*Primary Examiner*—Danton D. DeMille

*Attorney, Agent, or Firm*—Panitch Schwarze Jacobs & Nadel

[57] ABSTRACT

A radio-control toy vehicle is provided with six non-steerable wheels, three on each lateral side of the vehicle. At least the center wheel on each lateral side is drivingly coupled with a separate, reversible motor. The vehicle is steered by controlling the operation and direction of each motor. The wheels are arranged and the vehicle statically balanced such that the vehicle is supported by the center pair of wheels and one of the two remaining front and rear pairs of wheels, preferably the rear pair of wheels, when the vehicle is stationary on a level, horizontal surface. The vehicle is dynamically balanced so that when the wheels of the middle pair are driven in opposite linear directions, the vehicle spins rapidly about a vertical axis located directed between the middle pair of wheels and further pitches automatically slightly forwardly around the middle pair of wheels to lower the front end of the vehicle while raising the rear end and rear pair of ground-contacting wheels from the ground, so that the vehicle is supported only on the center pair of wheels.

25 Claims, 2 Drawing Sheets

VEHICLE TOY

FIELD OF THE INVENTION

The present invention relates to vehicle toys and, in particular, to remotely controlled vehicle toys having unusual performance capabilities, equalling and even exceeding those of the conventional vehicles.

BACKGROUND OF THE INVENTION

Radio-control toy vehicles are well known, and have grown to constitute a significant specialty toy market.

Manufacturers in this market attempt to duplicate well-known cars, trucks and other conventional vehicles and the latest in automotive developments, including specialty entertainment vehicles such as the so-called "monster" four-wheel drive and tracked vehicles. In the latter type of vehicles, the tracks are separately and individually driven, providing such vehicles with an essentially zero turning radius. Such tracked vehicles are much more maneuverable than conventionally steered, wheeled vehicles. However, the use of tracks can make such vehicles slower than comparable, wheeled vehicles in straight acceleration due to drag associated with the tracks.

It would be desirable to provide a vehicle toy having the straight acceleration capabilities of a wheeled vehicle, combined with the zero turning radius capability of a tracked vehicle for optimum performance.

SUMMARY OF THE INVENTION

In one aspect, the invention is a toy vehicle comprising: a chassis having first and second lateral sides and front and rear ends; at least a first pair of ground-contacting wheels, each wheel of the first pair being located proximal a separate one of the first and second lateral side of the vehicle; motor means drivingly coupled at least with each of the ground contacting wheels of the first pair for selectively driving at least the first pair of wheels at least simultaneously in the same linear direction or simultaneously in opposite linear directions; a third support extending generally downwardly from the vehicle at some point to the front or rear of the first pair of wheels, the third support and the first pair of wheels being located to directly contact and support the chassis on a level, horizontal surface, at least when the vehicle is stationary; and the vehicle being balanced such that when the first and second wheels are driven sufficiently rapidly simultaneously in opposite linear directions on the level, horizontal surface, the vehicle rotates about a vertical axis located longitudinally in the vehicle between the first pair of wheels and the chassis pitches partially around the first pair of wheels sufficiently to raise at least the one end of the chassis and the third support away from the level, horizontal surface.

In another aspect, the invention is a toy vehicle comprising: a chassis having first and second lateral sides and front and rear ends; at least front, middle and rear wheels proximal each of the lateral sides of the vehicle; a first reversible electric motor drivingly coupled with at least the middle wheel proximal the first lateral side of the vehicle; a second reversible electric motor drivingly coupled independently of the first motor with at least the middle wheel proximal the second lateral side of the vehicle; and the pair of middle wheels and only one of the pairs of front and rear wheels contacting a level horizontal surface and supporting the vehicle when the vehicle is stationary, the remaining one of the pairs of front and rear wheels being elevated off the level horizontal surface when the vehicle is stationary; and the vehicle being balanced to spin about a vertical axis located longitudinally in the vehicle between the middle pair of wheels when the middle pair of wheels are driven sufficiently rapidly by the first and second motors in opposite linear directions on the surface.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, which are diagrammatic.

DETAILED DESCRIPTION OF PREFERRED EMBODIMENT

Figure 1:
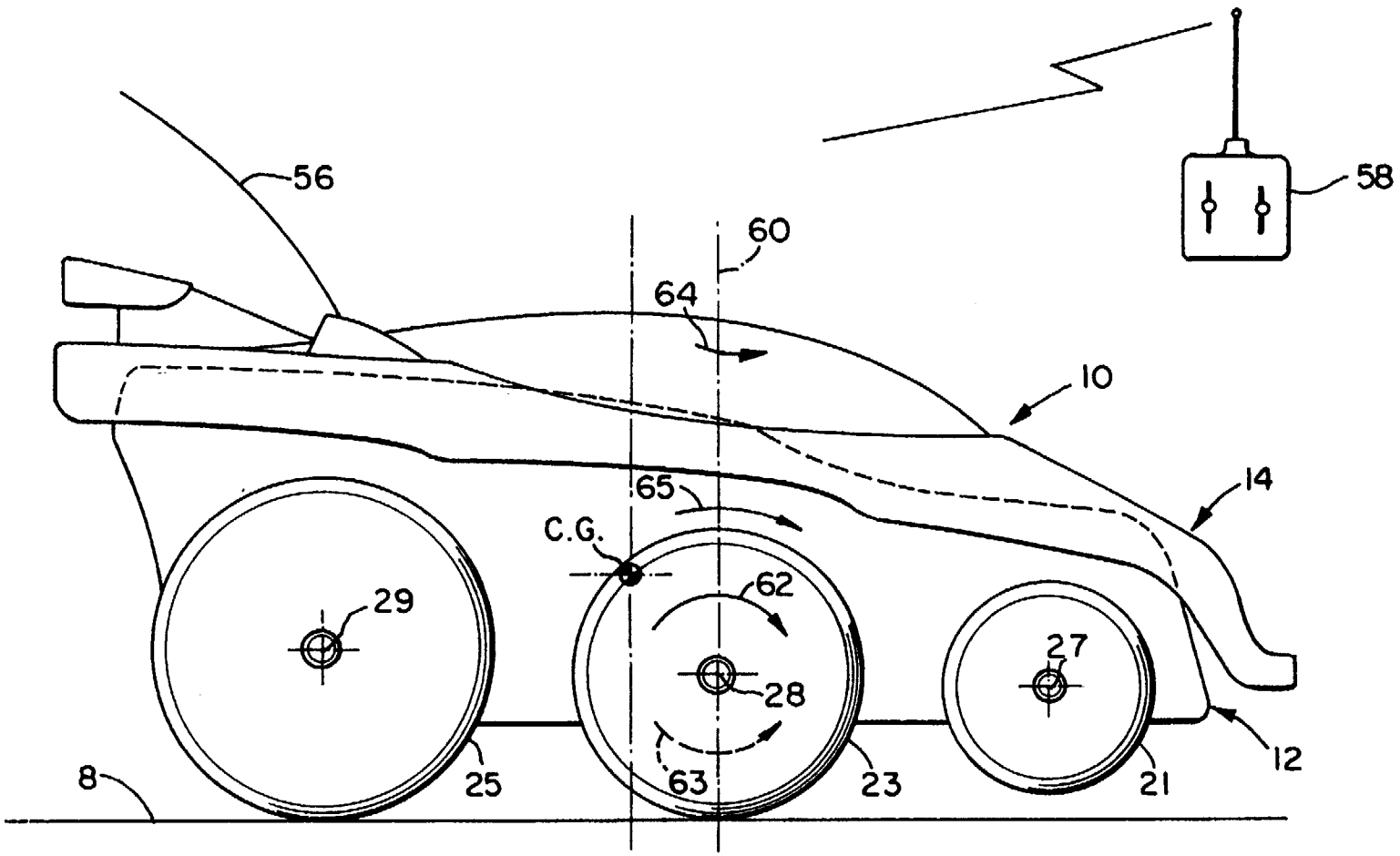
FIG. 1 is a side elevation of a first embodiment of the invention.

In the drawings, like numerals are used to indicate like elements.

Figure 2:
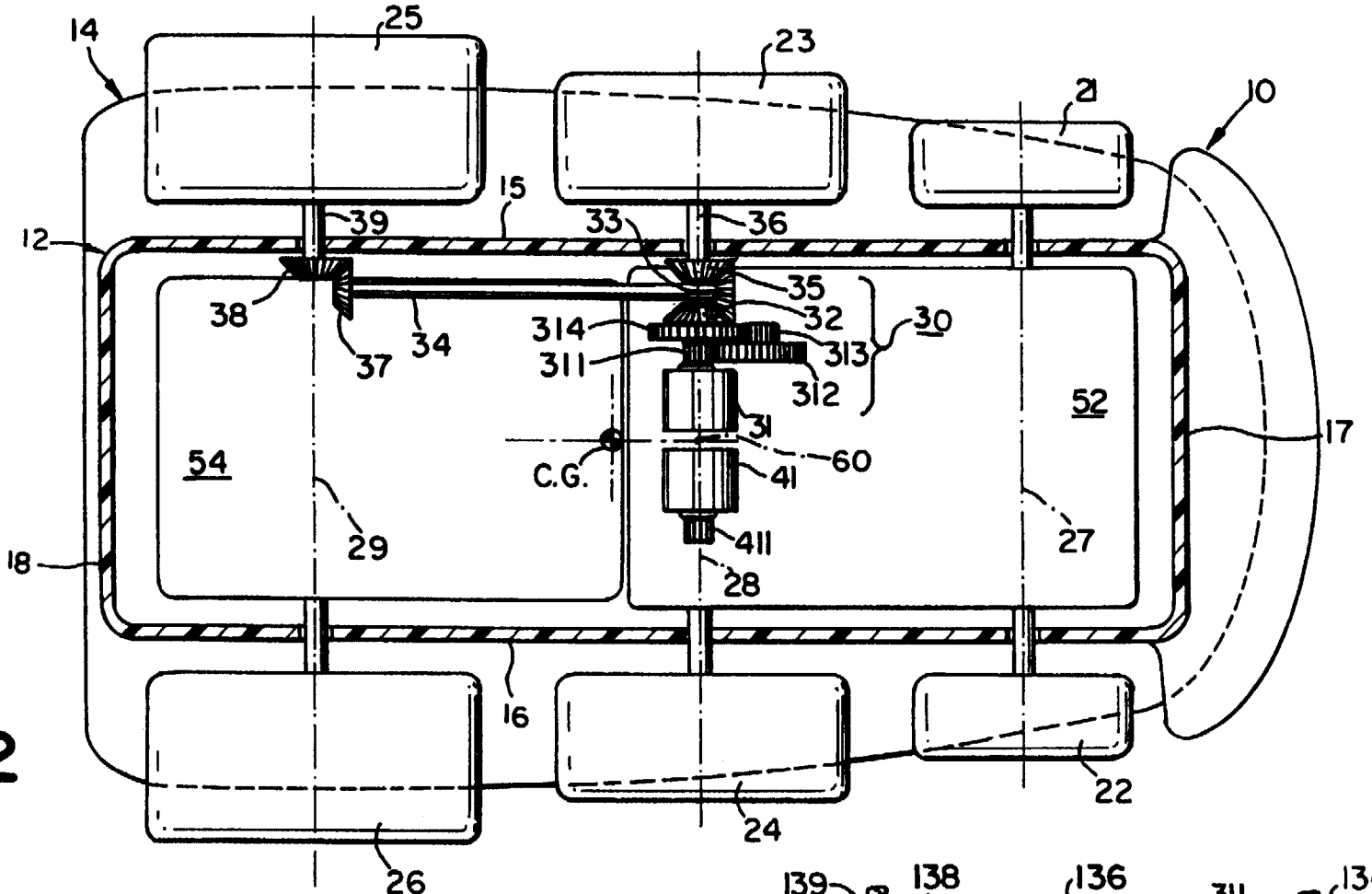
FIG. 2 is a broken away bottom plan of the toy vehicle of FIG. 1.

A preferred toy vehicle of the present invention is indicated general at 10 in FIGS. 1 and 2. The vehicle 10 preferably comprises a substantially integral and rigid chassis, indicated generally at 12, supporting an aerodynamically shaped body, indicated generally at 14. Chassis 12 has left and right lateral sides 15 and 16, respectively, and front and rear ends 17 and 18, respectively. Preferably, front, middle and rear wheels 21, 23, 25 and 22, 24, 26 are mounted to the chassis 12 proximal the right and left lateral sides 15 and 16, respectively, preferably along and facing exposed outer surfaces of the opposing sides 15, 16, at mirror-image positions. Preferably, the front, middle, and rear wheels 21, 23, 25 and 22, 24, 26 progressively increase in diameter along each lateral side 15, 16 of the chassis. Preferably, the axial width of the wheels and the center to center spacing between the wheels (track) of each pair 21/22, 23/24, 25/26 also vary progressively, preferably increasing from the front pair to the rear pair of wheels. The front pair 21, 22, the middle pair 23, 24, and the rear pair of wheels 25, 26 are preferably mounted for rotation about spaced, generally parallel and horizontal front, middle, and rear axes 27, 28 and 29, respectively.

According to an important aspect of the present invention, at least the middle pair of wheels 23, 24 are independently and reversibly driven. Preferably, the middle and rear wheels 23, 25 and 24, 26 on each lateral side of the vehicle are driven in unison and independently of the middle and rear wheels on the opposing side of the vehicle. FIG. 2 depicts diagrammatically a first lateral side drive, which is indicated generally at 30 on the right side of the chassis 12. Drive 30 preferably includes a first reversible electric motor 31 mounting a pinion 311 driving a train of gears and shafts. Pinion 311 directly drives mated reduction gears 312,313 which, in turn, drive a second reduction gear 314 mounting first bevel gear 32. Preferably, first bevel gear 32 mates with a bevel gear 33, which is fixedly coupled to an end of drive shaft 33 extending longitudinally to proximal the rear and of the chassis. Preferably, a third bevel gear 35 mates with second bevel gear 33 and drives a laterally extending drive shaft 36. Preferably, middle wheel 23 is fixedly coupled with the opposing end of drive shaft 36. Preferably, a fourth bevel gear 37 on shaft 34 drives a fifth bevel gear 38 coupled to a drive shaft 39. Rear wheel 25 is fixedly coupled to an opposing end of the drive shaft 39. If desired, another bevel gear and shaft may be provided extending forwardly within the chassis to proximally the front wheel 21, and the front wheel 21 driven in a manner mirroring the drive of rear wheel 25. Preferably, the ratio of the bevel gears 32, 33, 35, 37 and 38 are selected such that the middle and rear wheels 23 and 25 are driven through those gears to turn at different rotational speeds (e.g., rpm) but to travel at identical linear speeds along a surface 8 supporting the vehicle 10, taking into account their different outer diameters.

Preferably too, the middle and rear wheels 24 and 26 along the remaining lateral side 16 (or the front, middle and rear wheels along that side) are driven by a second similar, if not identical drive including a second reversible electric motor 41, which preferably duplicates and parallels the first side drive train 30 within the chassis 12 of the vehicle. Preferably, wheels 21 and 22 are mounted for free, independent rotation on a single axle coaxial with axis 27.

Figure 3:
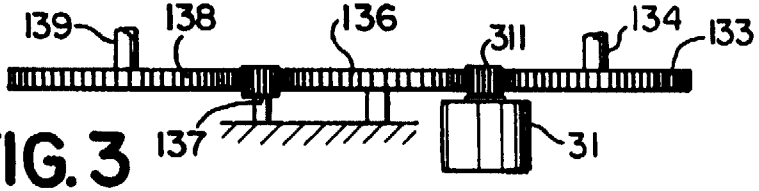
FIG. 3 is an alternative drive arrangement.

It will be appreciated that drive 30 or its mirror could be provided by an almost innumerable variety of configurations employing gears and/or other known rotational power transfer mechanisms previously employed in such toys, other vehicles and other rotary-motion machines and equipment. For example, a drive train of spur gears and idlers like that shown in FIG. 3 may be used to reduce rotational speed and transfer power from either motor 31, 41 to any or all driven wheels along one side of the vehicle, thereby eliminating longitudinal drive shafts like shaft 34. In FIG. 3, motor 31 and its pinion 311 drive a larger, reducing spur gear 133 supporting a middle wheel of the vehicle (not depicted) on axle 134 similar to original wheel 23 on axle 36. Pinion 311 similarly drives a reduction idler gear 136, which in turn drives a reversing idler gear 137, which in turn drives another spur gear 138 rotating an axle 139, similar to the axle 39 in FIG. 2 supporting a rear wheel like wheel 25. Additional idler(s) and gear(s) could be used to transfer rotational motion from pinion 311 through gear 133 to a third axle mounting a front wheel. Again, the ratio of the various gears 133 and 136 through 138 are preferably selected so that axles 134 and 139 rotate at different rotational speeds while the different diameter wheels with which they are connected rotate at the same linear speed at their circumferences which contact a support surface 8.

Furthermore, appreciating how vehicle 10 performs, it is conceivable that one of ordinary skill could use a single motor with appropriate shiftable transmission to selectively drive at least the middle pair of drive wheels on either side of the vehicle simultaneously in the same or simultaneously in opposing linear directions and to suitably balance the vehicle so that only the one pair of drive wheels remains in contact with surface 8 when the one pair of drive wheels are driven sufficiently fast in opposite linear directions. Such a configuration might beneficially be employed in a wire controlled vehicle in which power is supplied from a control power pack separate from the vehicle, thereby eliminating the weight of the electrical power source from the vehicle.

Control of the first motor 31 and of its mirror-image second motor 41 preferably is entirely conventional. A radio-control system which may be used is disclosed in U.S. patent application Ser. No. 07/759,250, now U.S. Pat. No. 5,135,427, which is assigned to the assignee of this application and incorporated by reference herein in its entirety. The receiving portion of the system, which is located in the vehicle 10, is configured to selectively drive the two motors separately and individually in either direction or simultaneously in the same or in opposite directions, and to switch from any mode to any other mode, all by remote control while the vehicle is moving.

Preferably, the vehicle 10 includes an electronic receiver/controller package indicated diagrammatically at box 52, which is preferably provided on a circuit board suitably supported and protected within the chassis 12. Electronic package 52 may be provided, for example, with a radio receiver circuit for radio signal detection and demodulation, an amplifier circuit, a data processing circuit to decode and respond to the radio-control signals detected, and drive circuits for appropriately coupling the first and/or second electric motors 31 and 41 with appropriate polarities of a suitable electric power source, indicated generally at 54. Power source 54 may be a large single battery, a pack of several batteries or some other power source, rechargeable or nonrechargeable, for reversible operation of either provided motor. The circuitry of the electronic package 52 would be electrically connected to a suitable antenna 56, which extends out of the body 14 and receives radio signals transmitted by an appropriate remote transmitter unit, indicated generally at 58 in FIG. 1. Wire control and other forms of wireless control, including light and/or sound generation/detection, might be used in the alternative. In the case of wire control, electric current for the motor(s) may be conveniently supplied through the wires and the power source 54 eliminated from the vehicle, if desired.

In yet another important aspect of the present invention, although the vehicle 10 is preferably supplied with six wheels, only the middle pair of wheels 23, 24 and one other pair of wheels, preferably the driven rear pair of wheels 25 and 26, are normally ground contacting. That is, wheels 23–26 are mounted to the chassis in a way in which all four wheels 23–26 are in direct contact with and directly support the vehicle 10 on a level, horizontal surface 8. Front wheels 21 and 22 are preferably elevated off the level, horizontal surface 8, at least when the vehicle 10 is stationary, so that the vehicle 10 is normally supported by only two of the three pairs of wheels, preferably the two driven pairs of wheels. In a normal forward driving mode, the middle and rear pairs of wheels 23–26 remain in contact with the level, horizontal surface while front wheels 21 and 22 remain elevated off that surface. In the event of rapid, reverse acceleration along the horizontal surface 8, the vehicle 10 may at least initially pitch onto the front wheels 21 and 22, raising rear wheels 25 and 26 from the surface 8 and resting on the front wheels 21, 22. If the middle or rear pair of driven wheels were to become elevated on an uneven surface, drive would continue to be provided by the remaining pair of driven wheels 23, 24 or 25, 26.

According to yet another important aspect of this embodiment, none of the six wheels 21–26 is steerably mounted to the chassis. That is, none of wheels 21–26 is mounted to, or coupled with the chassis in a way that enables such wheel to pivot with respect to the chassis 12 about a vertical axis. Consequently, all steering of vehicle 10 is performed either by powering only the driven wheel(s) along one lateral side 15 or 16 of the vehicle 10, or by powering the driven wheel(s) along each lateral side of the vehicle in opposite linear (forward/reverse) directions.

Another important aspect of the present invention relates to the turning and steering capability of the vehicle 10 and other embodiments of the invention. The static center of gravity CG of the vehicle 10 (center of gravity at rest) is preferably laterally centered in the vehicle and located longitudinally between the driven middle pair of wheels 23, 24 and the remaining, normally ground-contacting pair of wheels 25, 26, but preferably proximal the middle pair 23,24. However, the vehicle 10 is also dynamically balanced such that when the center wheels 23 and 24 are driven sufficiently rapidly in opposite linear directions on the support surface 8, the vehicle rotates automatically about a vertical axis 60. Axis 60 is laterally centered in the vehicle and is longitudinally located directly between the center pair of wheels 23, 24, at least proximal to, if not actually intersecting, their common axis of rotation 28. When rotated, the vehicle 10 simultaneously pitches slightly forwardly around the center pair of wheels 23, 24 and their axis 28, raising the rear end 18 of the chassis 12, and the rear pair of wheels 25, 26 from the support surface 8, so that the vehicle 10 is then supported only on the middle pair of driven wheels 23 and 24. For example, if wheel 23 is driven clockwise in the direction of arrow 62 and wheel 24 is oppositely driven in the direction of phantom arrow 63, the vehicle 10 will spin rapidly in a counterclockwise direction around axis 60, as indicated by arrowed line 64, while the chassis 12 and body 14 pitch slightly forwardly around wheels 23, 24 and their common axis 28 in the direction of arrowed line 65 sufficiently to raise the rear end 18 and rear wheels 25, 26 while slightly lowering the front end 17. The vehicle 10 is balanced such that the front end 17 is not lowered sufficiently for front wheels 21, 22 to contact the level, horizontal support surface 8. By simultaneously maintaining the front and rear ends 17 and 18 and the front pair 21, 22 and rear pair 25, 26 of nonsteerable wheels elevated, vehicle 10 can be made to turn, and even spin, extremely rapidly on only its middle pair of wheels 23, 24, about the vertical axis 60 as scuffing by and dragging of the other, nonsteerable, front and rear wheels are eliminated. Preferably, the vehicle 10 is powered and geared to be capable of driving the vehicle in forward and reverse directions at linear speeds in excess of about 10 kph, desirably at speeds on the order of about 15 kph or more and, preferably, at speeds on the order of about 20 kph.

It will appreciated that the rapid turning (spinning) ability of vehicle 10 can be achieved in other ways. For example, if one were willing to forego additional drive of either the front or rear pair of wheels, or both, casters which freely pivot three-hundred and sixty degrees about a vertical axis or a ball in socket could be substituted for any or all of the front and rear wheels 21, 22, 25, and 26 and permitted to remain on the ground during spinning. Furthermore, if desired, only one caster or ball need be provided for either end pair of wheels 21, 22 or 25, 26, preferably located along the longitudinal centerline of the vehicle. Preferably, at least one pair of rear wheels 25 and 26 or front wheels 21 and 22 is provided and remains drivingly connected to the reversible electric motors 31, 41, so that, in the event the vehicle were positioned on a surface where only front and rear wheels or their equivalents were in contact with the ground, the vehicle would still be drivable.

It will be further appreciated that vehicle 10 might further be modified by retaining the centrally located pair of laterally opposed driven wheels 23 and 24 and providing a single ball or wheel, pivotally or non-pivotally mounted, for the driven, nonsteerable rear wheels 25, 26, and the front wheels 21, 22 discarded entirely and replaced with one or more skid surfaces supported from or incorporated into the chassis or body to at least nearly duplicate the performance of the preferred vehicle 10, at least on a level, horizontal surface.

Preferably, the middle pair of wheels 23, 24 is located near the longitudinal center of the vehicle, and near the static center of gravity (CG) of the vehicle 10, so that the vehicle 10 will tend to spin easily and stably about the vertical axis 60 while remaining in a generally stationary location on the support surface 8. Preferably too, the centers of the center pair of wheels are dropped about ⅛ inch from a line along each lateral side of the vehicle 10, through the centers of the front and rear wheels, and the vehicle statically balanced essentially over the center pair of wheels with a slight rearward bias, preferably so that the rear tires just touch a level horizontal surface supporting the vehicle on the center pair of wheels. It should be appreciated that the farther the center point between drive wheels 23, 24 is displaced longitudinally or laterally from the static center of gravity CG of the vehicle, and/or the vehicle 10 is not dynamically balanced to spin about a vertical axis centered laterally and longitudinally directly between the middle pair of wheels 23, 24, the more likely will be the tendency of the vehicle 10 to move about laterally while spinning, and even to break away and spin out of position, due to unbalanced dynamic forces. The tires on each of the wheels 21–26, or at least the center wheels 23, 24, may be provided with a slight circumferential crown to further enhance rapid spinning capability.

While preferred embodiments of the invention have been disclosed, and modifications thereto suggested, still other changes will occur to those of ordinary skill in the art. For example, additional driven or undriven wheels may be provided in addition to the six disclosed and/or conventional steering provided and combined with the disclosed spin capability. Also, while wireless control is preferred, less expensive embodiments can be made with wire control and/or internal self control, e.g. so-called "cam-o-matic" drives which mechanically pre-program the operation of the vehicle. In wire-controlled vehicles, the vehicle power control circuitry can be located in the remote hand control, left in the vehicle or split between the hand control and the vehicle. Accordingly, it should be understood that this invention is not limited to the particular embodiments disclosed, but is intended to cover any modifications within the scope and spirit of the invention, as defined by the appended claims.

We claim:

1. A toy vehicle comprising:

a chassis having first and second lateral sides and front and rear ends;

at least a first pair of ground-contacting wheels, each wheel of the first pair being located proximal a separate one of the first and second lateral sides of the vehicle;

motor means drivingly coupled at least with each of the ground contacting wheels of the first pair for selectively driving at least the first pair of wheels at least simultaneously in the same linear direction or simultaneously in opposite linear directions, the motor means comprising a first reversible electric motor drivingly coupled with a first one of the first pair of wheels proximal the first lateral side of the vehicle and a second reversible electric motor, independently operable from the first motor and drivingly coupled with a second one of the first pair of wheels proximal the second lateral side of the vehicle;

a third wheel extending generally downwardly from the vehicle at some point to the front or rear of the first pair of wheels, a fourth wheel forming a second pair of ground contacting wheels with the third wheel, the third and fourth wheels being located in mirror positions proximal the first and second lateral sides of the chassis between the first pair of wheels and the one end of the vehicle, the third wheel being drivingly coupled with the first reversible electric motor and the fourth wheel being drivingly coupled with the second reversible electric motor, the third and fourth wheels and the first pair of wheels being located to directly contact and support the chassis on a level, horizontal surface, at least when the vehicle is stationary; and the vehicle being balanced such that when the first pair of ground contacting wheels are driven sufficiently rapidly simultaneously in opposite linear directions on the level, horizontal surface, the vehicle rotates about a vertical axis located longitudinally in the vehicle between the first pair of wheels and the chassis pitches partially around the first pair of wheels sufficiently to raise at least the one end of the chassis and the third and fourth wheels away from the level, horizontal surface.

2. The vehicle of claim 1 wherein none of the vehicle wheels is steerably mounted to pivot with respect to the chassis about a vertical axis.

3. The vehicle of claim 1 wherein the wheels of the first pair differ in diameter from wheels of the second pair and further comprising a drive train between the first motor and the first and third wheels, the drive train rotating the first and third wheels at different rotational speeds to provide the first and third wheels with identical linear speeds on the surface.

4. The vehicle of claim 1 further comprising a third pair of wheels coupled with the chassis, the wheels of the third pair being located in mirror positions proximal the first and second lateral sides of the chassis longitudinally spaced from the first pair of wheels towards a remaining end of the chassis.

5. The vehicle of claim 4 wherein the three wheels on each lateral side of the chassis vary progressively in diameter along the lateral side.

6. The vehicle of claim 5 wherein the wheels of the first pair differ in diameter from wheels of the second pair and further comprising a drive train between the first motor and the first and third wheels, the drive train rotating the first and third wheels at different rotational speeds to provide the first and third wheels with identical linear speeds on the surface.

7. The vehicle of claim 6 wherein the spacing between centers of each of the three pairs of wheels and the diameters of each pair of wheels increase progressively from the front end to the rear end of the vehicle.

8. The vehicle of claim 7 wherein the wheels of the third pair are elevated from the level, horizontal surface when the vehicle is stationarily supported on the surface by the first and second pairs of ground contacting wheels.

9. The vehicle of claim 8 wherein none of the six wheels is mounted to pivot with respect to the chassis about a vertical axis.

10. The vehicle of claim 4 wherein the spacing between centers of each of the three pairs of wheels vary progressively from the front end to the rear end of the vehicle.

11. The vehicle of claim 4 being balanced such that the second and third pairs of wheels are all elevated from the level horizontal surface supporting the first pair of wheels when the vehicle is spun sufficiently rapidly about the vertical axis on the first pair of wheels.

12. A toy vehicle comprising:

a chassis having first and second lateral sides and front and rear ends;

at least front, middle and rear wheels proximal each of the lateral sides of the vehicle, the diameters of the front, middle and rear wheels varying progressively along each lateral side of the vehicle;

a first reversible electric motor drivingly coupled with at least the middle wheel proximal the first lateral side of the vehicle;

a second reversible electric motor drivingly coupled independently of the first motor with at least the middle wheel proximal the second lateral side of the vehicle; and the pair of middle wheels and only one of the pairs of front and rear wheels contacting a level horizontal surface and supporting the vehicle when the vehicle is stationary, the remaining one of the pair of front and rear wheels being elevated off the level horizontal surface when the vehicle is stationary; and the vehicle being balanced to spin about a vertical axis longitudinally located in the vehicle between the middle pair of wheels when the middle pair of wheels driven sufficiently rapidly by the first and second motors in opposite linear directions on the surface.

13. The toy vehicle of claim 12 further being balanced such that both the front pair and the rear pair of wheels are elevated from the surface when the vehicle is spinning sufficiently rapidly about the vertical axis.

14. The toy vehicle of claim 12 wherein the first motor is simultaneously drivingly coupled with the middle wheel and the one other surface contacting wheel proximal the first lateral side of the vehicle to drive the two wheels at the same linear speed and wherein the second motor is simultaneously drivingly coupled with the middle wheel and the one other surface contacting wheel proximal the second lateral side of the vehicle to drive the two wheels at the same linear speed.

15. The toy vehicle of claim 14 wherein none of the vehicle wheels is steerably mounted to pivot with respect to the chassis about a vertical axis.

16. The vehicle of claim 12 further comprising a control system configured to selectively operate the first and second motors at least simultaneously in the same rotating direction or simultaneously in opposing rotating directions.

17. A toy vehicle comprising:

a chassis having first and second lateral sides and front and rear ends;

at least a first pair of ground-contacting wheels, each wheel of the first pair being located proximal a separate one of the first and second lateral sides of the vehicle;

motor means drivingly coupled at least with each of the ground contacting wheels of the first pair for selectively driving at least the first pair of wheels at least simultaneously in the same linear direction or simultaneously in opposite linear directions, the motor means comprising a first reversible electric motor drivingly coupled with a first one of the first pair of wheels proximal the first lateral side of the vehicle and a second reversible electric motor, independently operable from the first motor and drivingly coupled with a second one of the first pair of wheels proximal the second lateral side of the vehicle;

a third wheel extending generally downwardly from the vehicle at some point to the front or rear of the first pair of wheels and a fourth wheel forming a second pair of ground contacting wheels with the third wheel, the third and fourth wheels being located in mirror positions proximal the first and second lateral sides of the chassis between the first pair of wheels and the one end of the vehicle, the third wheel being drivingly coupled with the first reversible electric motor and the fourth wheel being drivingly coupled with the second reversible electric motor, and the third and fourth wheels and the first pair of wheels being located to directly contact and support the chassis on a level, horizontal surface, at least when the vehicle is stationary; and a third pair of wheels coupled with the chassis, the wheels of the third pair being located in mirror positions proximal to first and second lateral sides of the chassis longitudinally spaced from the first pair of wheels towards a remaining end of the vehicle and the three wheels on each lateral side of the chassis varying progressively in diameter along the lateral side;

the vehicle being balanced such that when the first pair of ground contacting wheels are driven sufficiently rapidly simultaneously in opposite linear directions on the level, horizontal surface, the vehicle rotates about a vertical axis located longitudinally in the vehicle between the first pair of wheels and the chassis pitches partially around the first pair of wheels sufficiently to raise at least the one end of the chassis and the third and fourth wheels away from the level, horizontal surface.

18. The vehicle of claim 17 wherein the wheels of the first pair differ in diameter from wheels of the second pair and further comprising a drive train between the first motor and the first and third wheels, the drive train rotating the first and third wheels at different rotational speeds to provide the first and third wheels with identical linear speeds on the surface.

19. The vehicle of claim 18 wherein the spacing between centers of each of the three pairs of wheels and the diameters of each pair of wheels increase progressively from the front end to the rear end of the vehicle.

20. The vehicle of claim 19 wherein the wheels of the third pair are elevated from the level, horizontal surface when the vehicle is stationarily supported on the surface by the first and second pairs of ground contacting wheels.

21. The vehicle of claim 20 wherein one of the six wheels is mounted to pivot with respect to the chassis about a vertical axis.

22. The vehicle of claim 20 being balanced such that the second and third paris of wheels are all elevated from the level horizontal surface supporting the first pair of wheels when the vehicle is spun sufficiently rapidly about the vertical axis on the first pair of wheels.

23. A toy vehicle comprising:

a chassis having first and second lateral sides and front and rear ends;

at least a first pair of ground-contacting wheels, each wheel of the first pair being located proximal a separate one of the first and second lateral sides of the vehicle;

motor means drivingly coupled at least with each of the ground contacting wheels of the first pair for selectively driving at least the first pair of wheels at least simultaneously in the same linear direction or simultaneously in opposite linear directions, the motor means comprising a first reversible electric motor drivingly coupled with a first one of the first pair of wheels proximal the first lateral side of the vehicle and a second reversible electric motor, independently operable from the first motor and drivingly coupled with a second one of the first pair of wheels proximal the second lateral side of the vehicle;

a third wheel extending generally downwardly from the vehicle at some point to the front or rear of the first pair of wheels and a fourth wheel forming a second pair of ground contacting wheels with the third wheel, the third and fourth wheels being located in mirror positions proximal the first and second lateral sides of the chassis between the first pair of wheels and the one end of the vehicle, the third wheel being drivingly coupled with the first reversible electric motor and the fourth wheel being drivingly coupled with the second reversible electric motor, the third and fourth wheels and the first pair of wheels being located to directly contact and support the chassis on a level, horizontal surface, at least when the vehicle is stationary; and a third pair of wheels coupled with the chassis, the wheels of the third pair being located in mirror positions proximal to first and second lateral sides of the chassis longitudinally spaced from the first pair of wheels towards a remaining end of the chassis and wherein the spacing between centers of each of the three pairs of wheels vary progressively from the front end to the rear end of the vehicle;

the vehicle being balanced such that when the first pair of ground contacting wheels are driven sufficiently rapidly simultaneously in opposite linear directions on the level, horizontal surface, the vehicle rotates about a vertical axis located longitudinally in the vehicle between the first pair of wheels and the chassis pitches partially around the first pair of wheels sufficiently to raise at least the one end of the chassis and the third and fourth wheels away from the level, horizontal surface.

24. A toy vehicle comprising:

a chassis having first and second lateral sides and front and rear ends;

at least front, middle and rear wheels proximal each of the lateral sides of the vehicle;

a first reversible electric motor drivingly coupled with at least the middle wheel proximal the first lateral side of the vehicle;

a second reversible electric motor drivingly coupled independently of the first motor with at least the middle wheel proximal the second lateral side of the vehicle;

the pair of middle wheels and only one of the pairs of front and rear wheels contacting a level horizontal surface and supporting the vehicle when the vehicle is stationary, the remaining one of the pair of front and rear wheels being elevated off the level horizontal surface when the vehicle is stationary;

the first motor being simultaneously drivingly coupled with the middle wheel and the one other surface contacting wheel proximal the first lateral side of the vehicle to drive the two wheels at the same linear speed and the second motor being simultaneously drivingly coupled with the middle wheel and the one other surface contacting wheel proximal the second lateral side of the vehicle to drive the two wheels at the same linear speed; and the vehicle being balanced to spin about a vertical axis longitudinally located in the vehicle between the middle pair of wheels when the middle pair of wheels are driven sufficiently rapidly by the first and second motors in opposite linear directions on the surface.

25. The toy vehicle of claim 24 wherein none of the vehicle wheels are mounted to pivot with respect to the chassis about a vertical axis.

* * * * *